United States Patent [19]

Buxbaum et al.

[11] 4,275,123

[45] Jun. 23, 1981

[54] HOT-CATHODE MATERIAL AND PRODUCTION THEREOF

[75] Inventors: Charley Buxbaum, Baden; Gernot Gessinger, Birmenstorf; Sigfrid Strassler, Wettingen, all of Switzerland

[73] Assignee: BBC Brown Boveri & Company Limited, Baden, Switzerland

[21] Appl. No.: 26,547

[22] Filed: Apr. 3, 1979

[30] Foreign Application Priority Data

May 5, 1978 [CH] Switzerland ..... 4889/78

[51] Int. Cl.[3] ..... B22F 5/00

[52] U.S. Cl. ..... 428/547; 428/565; 428/664; 313/346 R

[58] Field of Search ..... 148/16.5; 428/547, 565, 428/664; 313/346 R

[56] References Cited

U.S. PATENT DOCUMENTS

| | | | |
|---|---|---|---|
| 3,911,309 | 10/1975 | Kümmel et al. | 313/346 R |
| 3,921,031 | 11/1975 | Dubois et al. | 313/346 R |
| 3,976,853 | 8/1976 | Tratner | 313/346 R |
| 4,019,081 | 4/1977 | Buxbaum et al. | 313/337 |
| 4,083,811 | 4/1978 | Bachmann et al. | 313/346 R |

*Primary Examiner*—Brooks H. Hunt

*Attorney, Agent, or Firm*—Oblon, Fisher, Spivak, McClelland & Maier

[57] ABSTRACT

A hot-cathode material in wire or sheet form, comprising a high-melting carrier metal, an oxide activator and a carbide reducing agent, and, optionally, a diffusion-promoting additive, the material comprising a core zone and at least one surface layer having different compositions or different concentrations of constituents therein which are such that, in operation, the rate of diffusion of the activator from the core zone is equal to or greater than the loss of activator from the surface layer. The material is made by a powder metallurgy/thermomechanical process.

12 Claims, 6 Drawing Figures

HOT-CATHODE MATERIAL AND PRODUCTION THEREOF

BACKGROUND OF THE INVENTION

1. Field of the Invention

This invention is concerned with a hot-cathode material in wire and sheet form and with a process for its production.

2. Description of the Prior Art

Hot-cathode materials for thermionic tubes are known in the art in numerous embodiments and with numerous combinations of materials. They range from the conventional oxide cathodes having a low operating temperature and a low emission current density but a long life, to complicated multi-material systems such as the so-called "reactive cathodes". The most widely used materials of the latter category are cathode materials of the type $W/W_2C/ThO_2$ ("thoriated tungsten cathodes"), which operate on the basis of a chemical reaction and supply of the activator from the interior and which have a relatively high operating temperature. They are distinguished by a long life coupled with moderate emission current density. It can be demonstrated that the work function of the electrons can be lowered and that the electrode emission properties can be improved by adding a platinum metal to the above-mentioned system (see, for example, German Offenlegungsschrift No. 1,614,541). Materials are also known which have a medium life and a higher emission current density, examples of such materials being the systems $Mo/Mo_2C/La_2O_3$ (see German Auslegeschrift No. 2,344,936) and $Mo/Mo_2C/La_2O_3/Pt$ metal and the like (see German Auslegeschrift No. 2,454,569). Hot-cathode materials are also known which are based on porous sintered bodies produced from powder mixtures of a high melting metal with a platinum metal, the pores of the sintered bodies being filled with a material containing the activator (see, for example, German Offenlegungsschrift No. 2,727,187). Such cathodes are particularly distinguished by high emission current density coupled with relatively low operating tempertures.

The above-mentioned cathode materials are almost exclusively sintered materials which are used in the form of small sheets, tablets and similar compact components for the manufacture of hot-cathodes. These materials are distinguished by a certain brittleness so that, in general, they cannot be shaped or can only be shaped with extreme difficulty or by accepting substantial deterioration in their physical properties. Their lack of ductility does not enable them to be produced in any desired dimensions or, for example, to be converted economically to wires, sheets and strips, which would enable their high emission current density to be used in practice. On the other hand, the available materials with a high emission current density which can be produced in these physical forms have a service life that is still too short for practical use, particularly in the case of small sizes. There is, therefore, a requirement for materials which combine, in an optimum manner, the good properties of the above-mentioned materials and which allow the design engineer maximum possible freedom in design.

SUMMARY OF THE INVENTION

A hot-cathode material has now been developed which combines good mechanical shaping characteristics with high heat resistance, toughness and insensitivity to shock, and which can be used to provide hot-cathodes which combine a high emission current density and a long life with a low heating power requirement.

According to one aspect of the present invention, a hot-cathode material in wire or sheet form is provided which is composed of a high-melting carrier metal, an oxide of a Group IIIb metal as activator, and a carbide of the carrier metal as reducing agent, and, optionally, a diffusion-promoting additive. The hot-cathode material is provided with a core zone and at least one surface layer having different compositions or different concentrations of constituents therein which are such that, in operation, the rate of diffusion of the activator from the core zone is equal to or greater than the loss of activator from the surface layer.

According to another aspect of the invention, a process is provided for the production of a hot-cathode material which comprises mixing powdered carrier metal having a particle size of 8.5$\mu$ to 10$\mu$ with a powdered activator having a particle size of 1.0$\mu$ to 10$\mu$, isostatically cold pressing the mixture under a pressure of 1,000 to 8,000 bar, heating the blank thus produced in a reducing hydrogen atmosphere at a temperature of 900° C. to 1,100° C. for 0.5 to 6 hours, sintering the blank at a temperature of 1,500° C. to 2,200° C. for 0.5 to 3 hours, and mechanically working the blank in order to shape it. At least one body so produced and intended to form the surface layer of the material is then assembled with at least one other body so produced and intended to form the core zone or an intermediate layer, or with a core comprising a diffusion-promoting additive or an intermediate layer comprising the additive, to form a composite. The workpiece thus produced is subjected alternately to a forgoing treatment at a temperature of 1,000° C. to 1,500° C. and an intermediate annealing treatment at a temperature of 1,000° C. to 1,150° C. for 15 to 60 minutes, and then alternately to a drawing or rolling treatment and the same intermediate annealing treatment. Finally, the workpiece is carburized in the form of a semi-finished article in a mixture of 0.5 to 5% by volume of $CH_4$ and 99.5 to 95% by volume of $H_2$.

The guiding concept on which the invention is based is the recognition that the limitation of the life of a reactive cathode of the dispenser-diffusion type described here depends on various parameters which determine the reaction kinetics and the material equilibrium. In order to maintain the cathode surface during the entire life of cathode, a mono-atomic layer of the element which is derived from the activator, is formed by reduction and it lowers the electron work function (this mono-atomic layer being necessary to obtain the required high emission current density). An equilibrium must exist between the degree of vaporization of the activator (amount vaporized per unit time) and the amount of activator dispensed into the surface layer. This means that the amount of activator, originating from the interior of the cathode, dispensed into the surface zone must at any time be equal to the amount vaporized at the surface. It has been found that it is not the loss of activator throughout the cross-section of the cathode, but only the loss of activator in the surface zone near the surface which determines the equilibrium. The depletion of the life-determining surface zone can now be prevented by providing a core zone, which acts as a reservoir and which provides a higher rate of migration of the activator. This leads to a layer-type construction of the cathode material to ensure that by virtue of the greater diffusion in the core zone, sufficient activator is at all times transported into the surface zone near the surface in order to compensate for the depleting of this surface zone.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
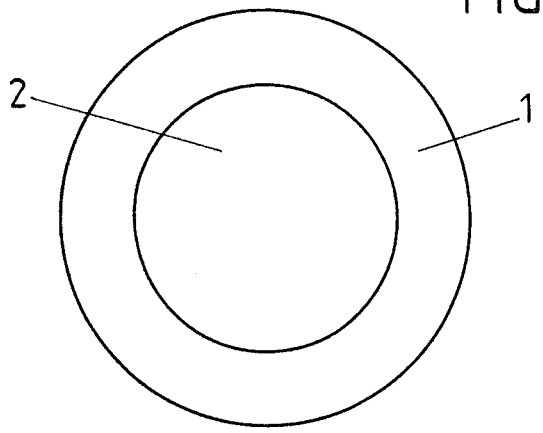
FIGS. 1 to 5 are diagrammatic cross-sections through different embodiments of a wire cathode.

FIG. 1 is a diagrammatic cross-section of a round wire of hot-cathode material which basically comprises a surface layer of 1 which is such that it permits only a relatively low radial rate of migration of the activator and a core zone 2 which is such that it permits a higher rate of migration of the activator. In general, transport of the activator depends essentially on the diffusion conditions of the particular material, from which it follows that the diffusion coefficient in zone 2 must be higher than in layer 1.

The hot-cathode material may be of any cross-section in accordance with this scheme. In other words, the material does not have to have a round cross-section, and may, for example, be polygonal or some other cross-sectional profile or in the form of a flat rod, strip or sheet.

Figure 2:
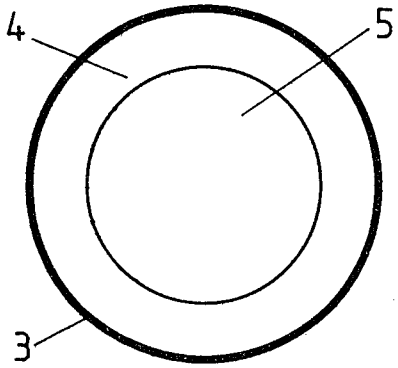

FIG. 2 is a diagrammatic cross-section of a round wire which is formed of three layers, an outer layer 3 consisting of or containing a diffusion-promoting additive, a surface layer 4 and a core zone 5. Individual platinum metals or a mixture of such metals may be used as the diffusion-promoting additive. The surface layer 4 and the core zone 5 may comprise the same constituents, but with different concentrations of the activator; the surface layer 4 containing a lower concentration of the latter than the core zone 5. When molybdenum is used as the carrier metal, lanthanum oxide ($La_2O_3$) is advantageously used as the activator, with the surface layer 4 having a concentration of 0.5 to 6%, preferably 0.5 to 1.5%, of the activator, and the core zone 5, a concentration of 2 to 8%, preferably 2 to 4%, of the activator. The cross-sectional area of the surface layer 4 may, for example, constitute 5 to 20% of the total cross-sectional area of the electrode.

Figure 3:
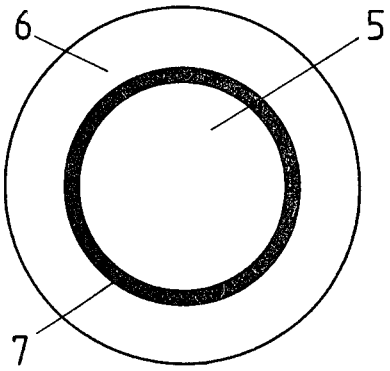

FIG. 3 is a diagrammatic cross-section of a round wire having a different sequence of the layer-type construction. Both the core zone 5 and the surface layer 6 have a relatively high concentration of 2 to 8%, preferably 2 to 4%, of activator (for example $La_2O_3$). The two zones are separated by an intermediate layer 7 of a platinum metal, preferably platinum, the cross-sectional area of which may account for 0.1 to 5% of the total cross-sectional area.

Figure 4:
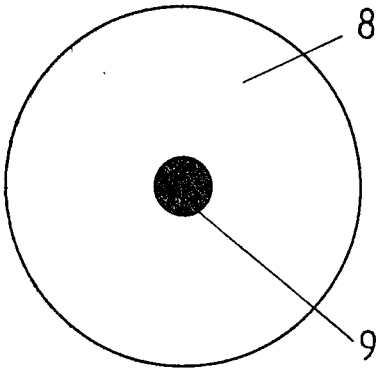

FIG. 4 is a diagrammatic cross-section of a further embodiment of a wire. The body of the hot-cathode material in this case mainly consists of a shell 8 of the material, containing 0.5 to 20%, preferably 2 to 6%, of activator. Within the shell 8 is a core 9 of a platinum metal, preferably Pt, which constitutes 0.1 to 2% of the total volume of the body.

Figure 5:
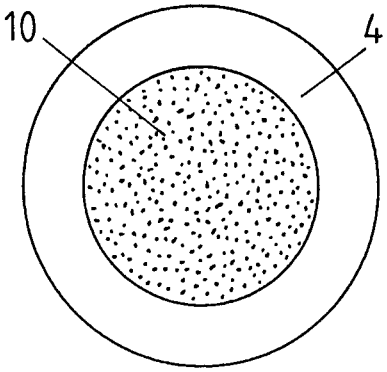

FIG. 5 is a diagrammatic cross-section of a round wire which comprises a surface layer 4 having a relatively low concentration of activator, which in the case of lanthanum oxide is preferably from 0.5 to 1.5%. The core zone 10 is provided with a higher concentration of activator, for example, 2 to 4% of $La_2O_3$, and in addition contains the diffusion-promoting additive in the form of a finely divided platinum metal. In the case of platinum, a concentration of 0.3 to 0.7% is preferably used for this purpose.

Figure 6:
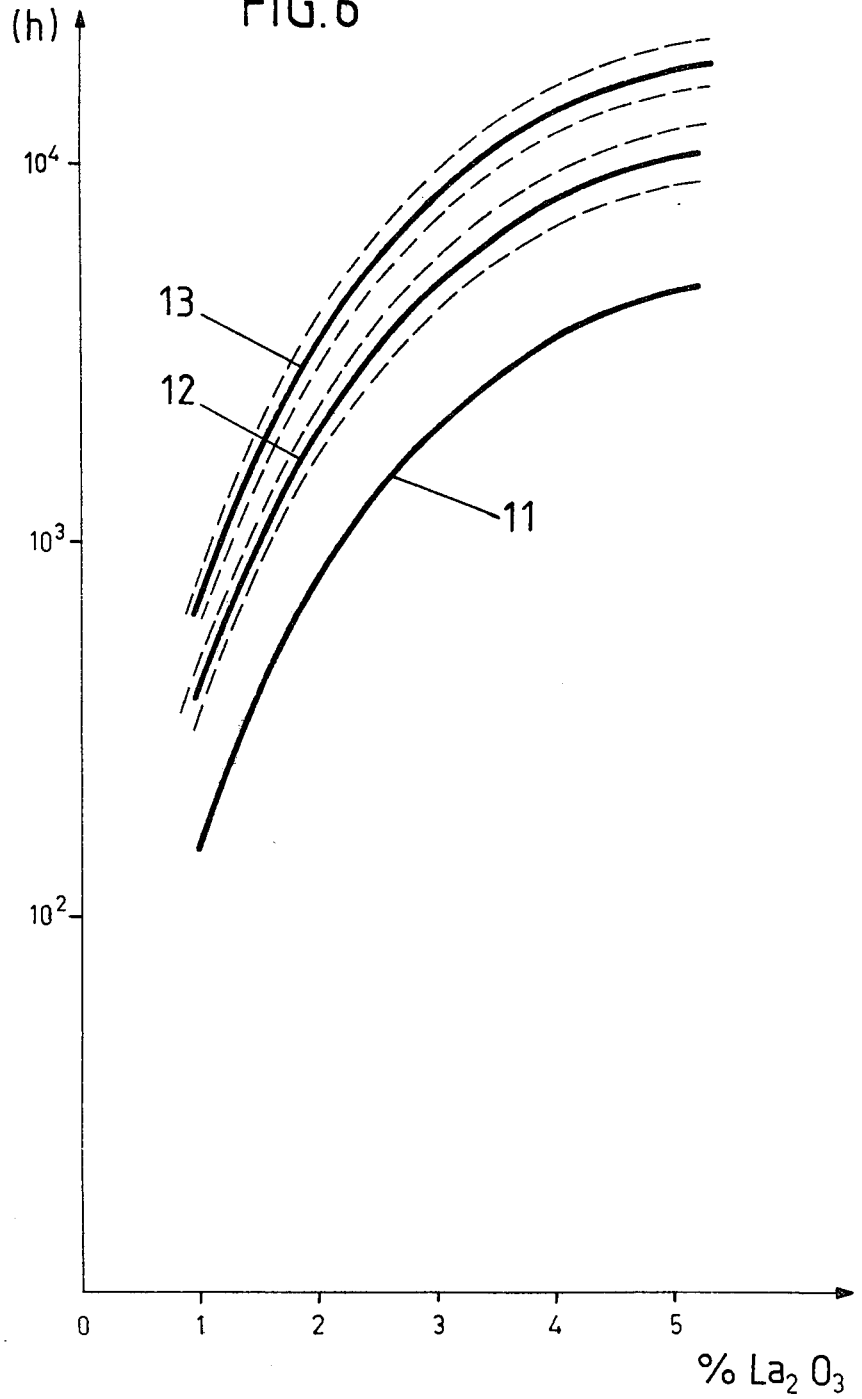
FIG. 6 is a graph showing the life of a cathode as a function of the concentration of the activator.

FIG. 6 is a graph showing the life of hot-cathode wires as a function of the concentration of activator at the start of operation. The wires investigated had a layer sequence as shown in FIG. 2 and FIG. 4, and had an external diameter of 0.6 mm. The carrier metal was molybdenum and the activator was of lanthanum oxide. Various curves have been plotted in the diagram. Curve 11 serves for comparative purposes and represents a cathode material of conventional, not layer-type, construction, based on a molybdenum carrier modified uniformly over the entire cross-section with lanthanum oxide and provided at its surface with a thin layer of platinum, the operating temperature being 1850° K. Curve 12 shows the dependence of the operating life (mean value) on the concentration of the activator $La_2O_3$ for cathodes with a layer-type construction, at an operating temperature of 1850° K. The outer broken lines indicate the range of scatter resulting from the particular construction according to the types shown in FIGS. 2 to 5. Curve 13 shows the mean value of the operating life for an operating temperature of 1820° K., the range of scatter again being marked by outer broken lines. In the experiments, the emission current density was 3.5 to 4.2 A/cm$^2$.

Having generally described this invention, a further understanding can be obtained by reference to certain specific examples which are provided herein for purposes of illustration only and are not intended to be limiting unless otherwise specified.

EXAMPLE 1

Refer to FIG. 2.

To produce a surface layer or a shell, 4,400 g of molybdenum powder of a particle size of 5$\mu$ were mixed for 60 minutes with 4 g of lanthanum oxide powder ($La_2O_3$) of particle size 1$\mu$ in a tumbler mixer. A cylinder of 18 mm diameter and 200 mm length was produced from this powder mixture and consisted of 99% by weight of Mo and 1% by weight of $La_2O_3$. The cylinder was formed by cold isostatic pressing under a pressure of 3,000 bars. The cylinder was pre-annealed under reducing conditions for 5 hours in a stream of hydrogen at a temperature of 1,000° C. This treatment substantially removed any dissolved or chemically bonded oxygen which may be present in the molybdenum. The blank was then sintered at a temperature of 1,700° C. for 1 hour to give a dense body (99.8% of the theoretical density). A hollow cylinder of 15 mm external diameter, 9 mm internal diameter and 170 mm length was then cut from the sintered body by machining.

To produce the core 5, 107.7 g of the above molybdenum powder were mixed with 3.3 g of the above lanthanum oxide powder in a tumbler mixer as described above, the content of $La_2O_3$ being 3% by weight. The core was formed and further treated as described above and turned down to 9 mm external diameter and 170 mm length.

The core and shell were then assembled together. With the temperature progressively decreasing from 1,400° C. to 1,200° C., the diameter of the resulting rod was reduced from 15 mm to 3 mm by swaging. An intermediate annealing operation for 30 minutes at a temperature of 1,100° C. in a hydrogen atmosphere was performed between any two shaping steps. Finally, the round wire thus obtained was brought to a final diameter of 0.6 mm by drawing at a temperature of 1,100° C., an intermediate annealing at 1,100° C. being carried out between any two drawing operations. The wire was carburized for 60 minutes at a temperature of 1,600° C., in a mixture of 3% by volume of methane and 97% by volume of hydrogen. The material thus produced can be used directly as a cathode wire. To improve its properties, particularly to increase the emission current density, the wire was finally provided with an electrolytically applied coating of a diffusion-promoting metal. In the present example, the wire was coated with a 5μ thick layer of platinum.

It should be understood that the specific conditions of the individual process steps as described above are by way of example and can, and should, be varied in accordance with the starting material used, the dimensions to be achieved and the end use. In particular, the carrier metal powder (for example molybdenum) may have a particle size of 0.5 to 10μ, while the particle size of the activator (for example lanthanum oxide) may be from 0.1 to 10μ. The cold isostatic pressing may be carried out under pressures of 1,000 to 8,000 bars. The preliminary annealing may be carried out for 0.5 to 6 hours in a temperature range of 900° to 1,100° C. and the sintering may be carried out for 0.5 to 3 hours in a temperature range of 1,500° to 2,200° C. The swaging process may be carried out in a temperature range of 1,500° to 1,000° C. and the intermediate annealing at 1,000° to 1,150° C., the duration of the latter preferably being 15 to 60 minutes. Advantageously, carburation is conducted with a mixture of 0.5 to 5% by volume of $CH_4$, the remainder $H_2$, at temperatures of 1,500° to 1,700° C. The platinum layer applied may have a thickness of 1 to 10μ.

EXAMPLE 2

Refer to FIG. 3.

A hollow cylinder serving as the shell and a core serving as the central body of an electrode were produced as described in Example 1. The core and the shell have the same content of activator, that is 3% by weight $La_2O_3$. Before assembling, the core was provided with an electrolytically deposited layer of platinum, 200μ thick. The core and the shell were then assembled and further processing was carried out exactly as described in Example 1.

The thickness of the diffusion-promoting additive deposited as an intermediate layer may be 1 to 250μ, depending on the dimensions and the end use.

EXAMPLE 3

Refer to FIG. 4.

A hollow cylinder serving as the shell was produced as described in Example 1; it contained 4% by weight of $La_2O_3$ and had a bore of 1 mm diameter. A platinum wire of 1 mm diameter serving as the diffusion-promoting additive was inserted into the bore. Further shaping was then performed as described in Example 1.

The thickness of the central body which forms the core and contains the diffusion-promoting additive (for example, platinum), or consists exclusively of the latter, may be 0.1 to 10 mm.

EXAMPLE 4

Refer to FIG. 5.

A hollow cylinder containing 1% by weight of $La_2O_3$ as the activator was produced as the shell by the process described in Example 1. A core, which in addition to 3% by weight of lanthanum oxide, contained 0.5% by weight of platinum was also produced. The platinum was added in the form of platinum black of a particle size of 0.5μ when the powdered starting materials were mixed. The further processing of the core and of the assembled body consisting of core and shell was carried out as described in Example 1.

The content of diffusion-promoting additive (for example, platinum) in the core may be from 0.1 to 1% weight and its particle size may be from 0.1 to 10μ.

The hot-cathode material according to the invention and the process for its manufacture are not limited to the Examples described above and shown in the Figures. In particular, carrier metals other than molybdenum, for example, tungsten, niobium or tantalum, or alloys of two or more of these metals can also be used. The same is true of the activators, where, in addition to lanthanum oxide, for example, yttrium oxide ($Y_2O_3$) or thorium oxide ($ThO_2$) can be used. The diffusion-promoting additive can be a platinum metal other than platinum itself, for example, palladium, rhodium, ruthenium and osmium, and alloys of two or more of these elements.

The process described above and the layer sequence of the hot-cathode material shown in the Figures furthermore is not limited to round wire cross-sections. Other profiles, as well as strips and sheets can also be produced with a similar large structure, in which case the swaging and hot-drawing steps may be replaced partially or entirely by hammering, pressing or hot-rolling operations. Extrusion of profiles is another possible type of shaping. It is only necessary to ensure that the layer-type structure of the starting body is preserved in the final semi-finished article obtained.

The hot-cathode material according to the invention is a material which, while retaining excellent mechanical properties such as heat resistance and high toughness, permits, by virtue of its ductility, optimum conversion to wire and sheet form, thus allowing the designer of high output thermionic tubes maximum possible freedom in shape and arrangement. By virtue of the layer-type construction of this material, the components produced therewith combine a relatively high emission current density with a long life.

Having now fully described this invention, it will be apparent to one or ordinary skill in the art that many changes and modifications can be made thereto without departing from the spirit or scope of the invention set forth herein.

We claim:

1. A hot-cathode in wire or sheet form, comprising a core zone and at least one surface layer, said zone and layer containing a mixture of a high-melting carrier metal, an oxide of a Group IIIb metal as an activator and a carbide of the carrier metal as a reducing agent, wherein the concentration of the activator in the surface layer is less than that in the core zone so that the rate of diffusion of the activator from the core zone is equal or greater than the class of activator from the surface layer.

2. The hot-cathode according to claim 1, wherein said mixture further comprises a diffusion-promoting additive.

3. The hot-cathode according to claims 1 or 2, wherein said mixture further comprises a platinum metal as the diffusion-promoting additive.

4. The hot-cathode according to claim 1, further comprising a diffusion-promoting additive in the form of an outer layer overlying the surface layer.

5. The hot-cathode according to claim 3, werein the diffusion-promoting additive is present in a finely divided form in the core zone.

6. The hot-cathode according to claim 1, wherein the carrier metal is molybdenum and the activator is lanthanum oxide.

7. The hot-cathode according to claim 6, wherein the concentration of lanthanum oxide is 2 to 8% in the core zone and 0.5 to 6% in the surface layer and the cross-sectional area of the surface layer is 5 to 20% of the total cross-sectional area.

8. The hot-cathode according to claim 3, wherein the diffusion-promoting additive is platinum.

9. The hot-cathode according to claims 6 or 7, wherein the concentration of lathanum oxide activator is 2 to 4% in the core zone and 0.5 to 1.5% in the surface layer.

10. The hot-cathode according to claim 2, wherein the diffusion-promoting additive is platinum, the carrier metal is molybdenum, the activator is lanthanum oxide and the core zone comprises 0.3 to 0.7% platinum and 2 to 4% lanthanum oxide, the surface layer comprises 0.5 to 1.5% lanthanum oxide and the cross-sectional area of the surface layer is from 5 to 20% of the total cross-sectional area.

11. The hot-cathode according to claim 1, wherein said hot-cathode is in the form of a wire of 0.1 to 10 mm diameter.

12. The hot-cathode according to claim 1, wherein said hot-cathode is in the form of a sheet of 0.1 to 2 mm thickness.

* * * * *